United States Patent [19]

Wedel

[11] Patent Number: 4,704,191

[45] Date of Patent: Nov. 3, 1987

[54] ELECTROMAGNETIC EXTENDED NIP PRESS

[75] Inventor: Gregory L. Wedel, Beloit, Wis.

[73] Assignee: Beloit Corp., Beloit, Wis.

[21] Appl. No.: 861,103

[22] Filed: May 6, 1986

Related U.S. Application Data

[63] Continuation of Ser. No. 689,800, Jan. 8, 1985, abandoned.

[51] Int. Cl.[4] ..... D21F 3/02; D21F 3/06

[52] U.S. Cl. ..... 162/358; 162/360.1; 100/118; 100/153; 100/917

[58] Field of Search ..... 162/358, 305, 360.1; 29/113 AD, 116 AD, 124; 100/118, 121, 153, 154, 917

[56] References Cited

U.S. PATENT DOCUMENTS 4,287,021 9/1981 Justus et al. ..... 100/153
4,290,353 9/1981 Pav et al. ..... 29/116 AD
4,485,540 12/1984 Riihinen .

FOREIGN PATENT DOCUMENTS 0021297 1/1981 European Pat. Off. .

*Primary Examiner*—S. Leon Bashore
*Assistant Examiner*—K. M. Hastings
*Attorney, Agent, or Firm*—Dirk J. Veneman; Raymond W. Campbell; David J. Archer

[57] ABSTRACT

Extended nip presses for papermaking machines and the like are provided with electromagnets immediately adjacent the press nip to create or augment the nip pressures or loads. The electromagnets have massive, wide large areas, establishing a concentrated magnetic field between conforming opposite sides of the entire nip area eliminating gaps heretofore encountered in magnetic presses. Non-magnetic belts convey wet webs through the nips of dewatering presses and dry web calendering presses can have the webs directly engage a calender roll conveying the web through the nip.

17 Claims, 14 Drawing Figures

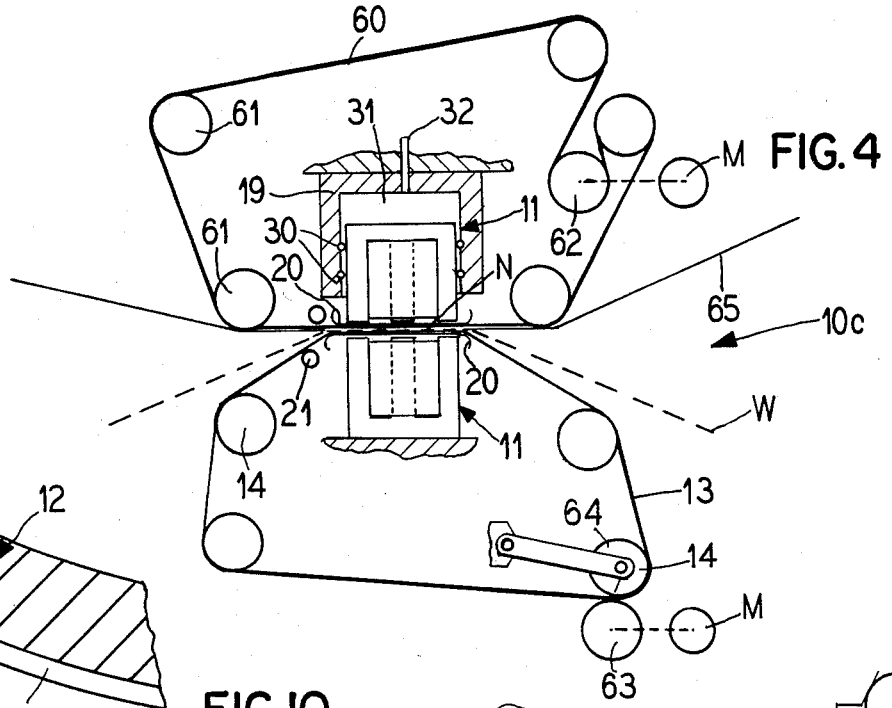
FIG. 4
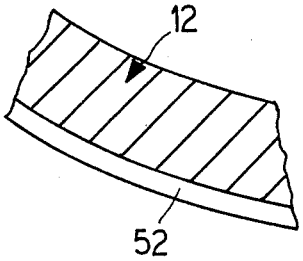
FIG. 10
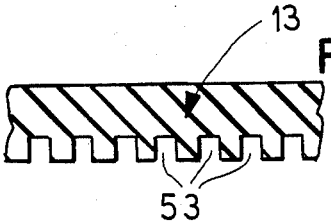
FIG. 11
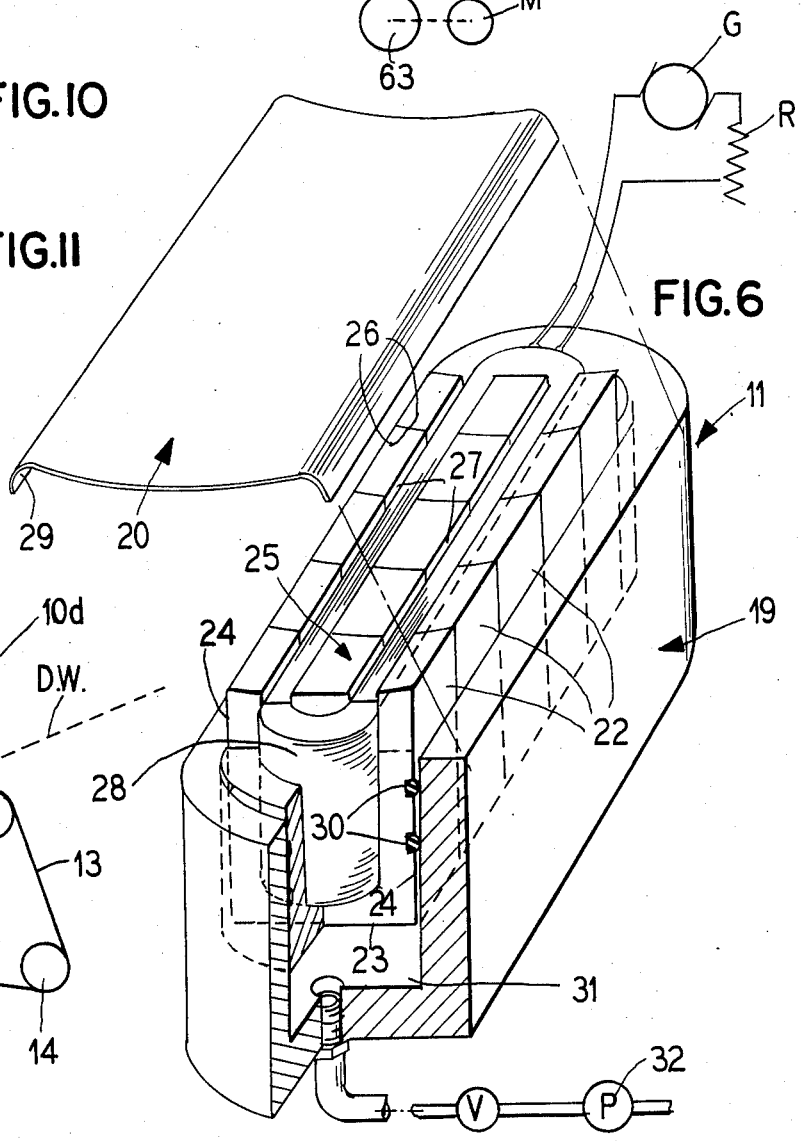
FIG. 6
FIG. 5
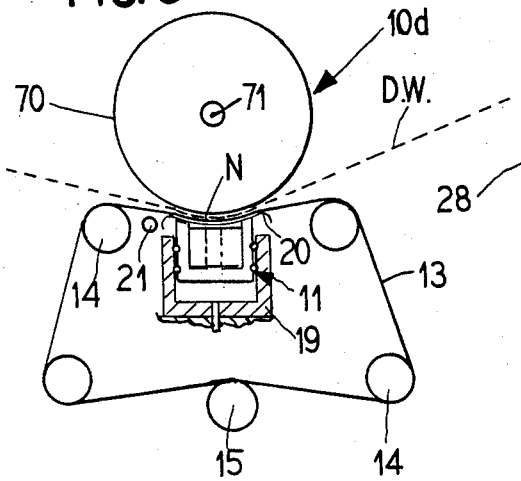

FIG.12
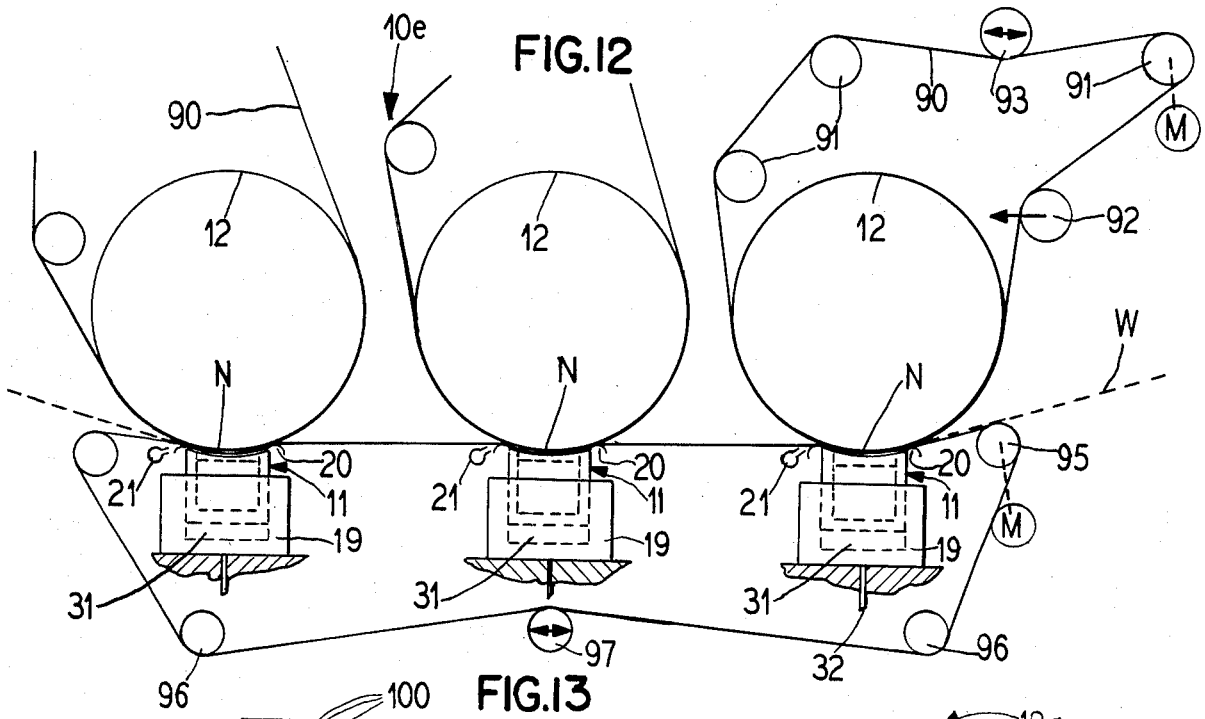
FIG.13
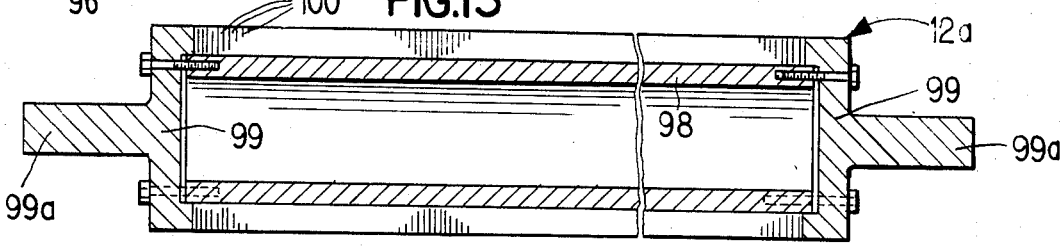
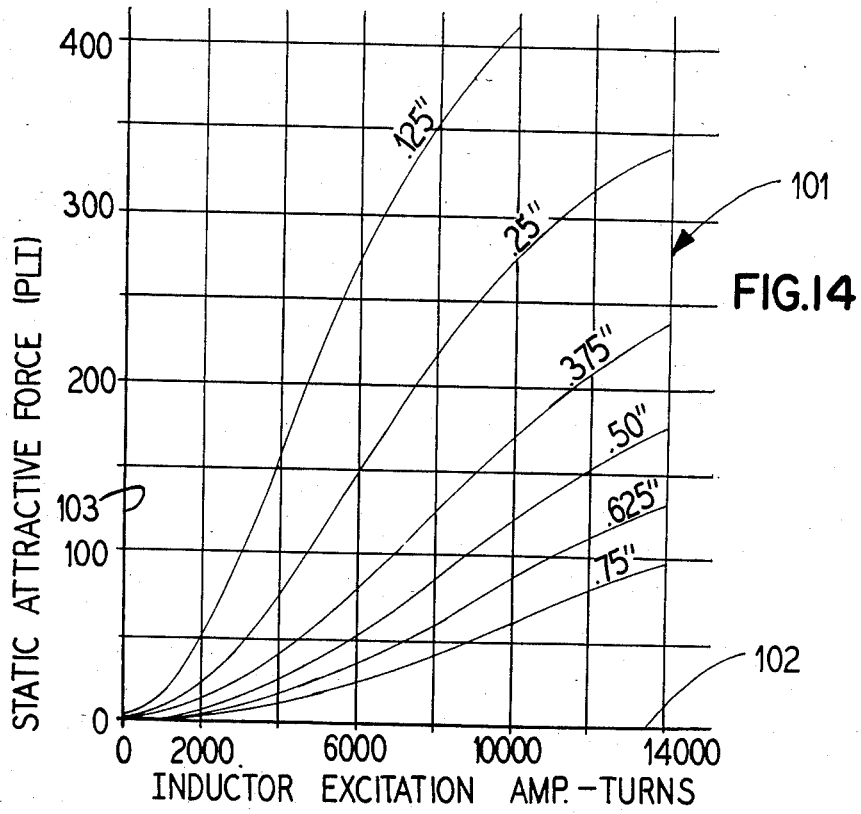
FIG.14

ELECTROMAGNETIC EXTENDED NIP PRESS

This is a continuation of co-pending application Ser. No. 689,800, now abandoned, filed on Jan. 8, 1985.

FIELD OF THE INVENTION

This invention relates to the art of extended nip presses for papermaking machinery and the like utilizing electromagnets with large area core faces coextensive with the extended nip area on at least one side of the nip maintaining a concentrated magnetic field through an opposed conforming magnetic nip member for efficiently creating or augmenting the nip load on the paper web conveyed through the nip. Specifically this invention deals with extended nip presses having electromagnets on one or both sides of the nip with cores defining extended area shoes attracting opposed conforming magnetic nip members minimizing flux gaps between the opposed members to increase the attraction force for creating or augmenting the nip load on paper webs or the like conveyed through the nip.

THE KNOWN PRIOR ART

Extended nip presses for papermaking machines are known in the art, for example from the disclosures of the Busker et al U.S. Pat. No. 3,738,225, issued July 24, 1973, and the Justus U.S. Pat. No. 3,783,097, issued Jan. 1, 1974. In these disclosures impervious belts convey the web through an extended wide nip created by hydraulically loaded shoes or pads. Roll presses with electromagnets in one roll attracting an opposing roll to create a nip load are also known, for example, from the disclosures of the McClenathan U.S. Pat. No. 3,456,582, issued Jul. 22, 1969. In such magnetic presses only a line nip is provided and wide gaps between the magnet and the opposed roll are formed due to the thickness of the roll housing the electromagnet and the converging and diverging air spaces at the entrance and exit to the line nip. These gaps substantially reduce the effectiveness of the electromagnet in creating the nip load.

It would, therefore, be an improvement in this art to create nip pressures or loads in extended nip presses by electromagnets having large area massive cores immediately adjacent an opposed magnetic member to minimize gaps therebetween for maintaining a strong wide magnetic field creating a desired nip load.

SUMMARY OF THE INVENTION

According to this invention an extended pressure nip for dewatering or calendering fibrous webs, such as paper, is formed by magnetically attracting a wide shoe on one side of the web and a wide conforming magnetic member on the opposite side of the web which may take the form of a roll or a pressure shoe. The magnet core is coextensive with the wide nip area, forms or intimately supports the shoe and develops a concentrated magnetic field across the entire nip area. The field flux only traverses a minimum path to the opposed nip member. The web is conveyed through the nip by an impermeable belt and may be covered on one or both faces with an absorbent felt in dewatering press installations or may directly engage a hard finishing roll in calendering installations. The nip forming component on one side of the web is shiftable under the influence of the magnetic flux created by the energized electromagnet. Thus, in installations having an electromagnet shoe and a roll, either the shoe or the roll is shiftable and in installations having electromagnets on both sides of the nip either one or both of the magnets may be shiftable.

A feature of the invention is the minimization of the gap through which the magnetic flux must pass to establish the nip load. This is accomplished by forming the pressure shoe with the electromagnet so that the flux does not have to pass through a surrounding roll before reaching the magnetic nip forming member on the opposite side of the web. The shoe and opposed member have coextensive wide large areas increasing and concentrating the magnetic inductance to more effectively pull the two sides of the wide area nip together.

Another feature of the invention is the provision of individual electromagnetic cores along the length of the nip to compensate for any irregularities in nip loads caused by deflection, uneven expansion and the like, of the components.

A still further feature of the invention is to provide individual coils for the electromagnetic cores which are adapted to be individually energized to control loads along the length of the nip.

It is then an object of this invention to provide extended nip presses for papermaking machines and the like where the nip loads are created or augmented by wide area electromagnetic shoes.

A further object of the invention is to provide dewatering presses and calenders for papermaking machines with wide extended magnetized nips establishing nip loads by magnetic attraction.

A further object of the invention is to provide a press roll assembly with an electromagnet energized shoe forming an extended nip with a cooperating magnetic roll and having a minimum gap between the electromagnet and the magnetic roll.

Another object of this invention is to provide an extended nip press for papermaking machines where the wide area nip is formed by opposed electromagnets enhancing magnetic coupling of opposed rigid nip members.

A still further object of the invention is to provide an electromagnet extended nip press where the press loads are created by concentrated flux lines between opposed conforming wide area rigid nip members.

Other and further objects and features of this invention will be apparent to those skilled in this art from the following detailed description of the annexed sheets of drawings, which by way of preferred examples show several best mode embodiments of the invention.

ON THE DRAWINGS

FIG. 4 is a schematic side view of an extended nip press of this invention having electromagnets on both sides of the nip;

FIG. 5 is a schematic side view of an extended nip calender type press of this invention;

FIG. 6 is an isometric view of a shiftable electromagnet shoe assembly for presses of this invention;

FIG. 10 is a cross-sectional view along the line X—X of FIG. 3;

FIG. 11 is a cross-sectional view along the line XI—XI of FIG. 3;

FIG. 12 is a schematic side view of multiple extended nip press of this invention;

FIG. 13 is a schematic longitudinal cross section view of a laminated press roll useful in the presses of this invention to minimize heating;

FIG. 14 is a graph showing nip loading as a function of electromagnet excitation and illustrating the increases in magentic coupling with decreases in gaps between the electromagnet core and the opposing magnetic member.

AS SHOWN ON THE DRAWINGS

Figure 1:
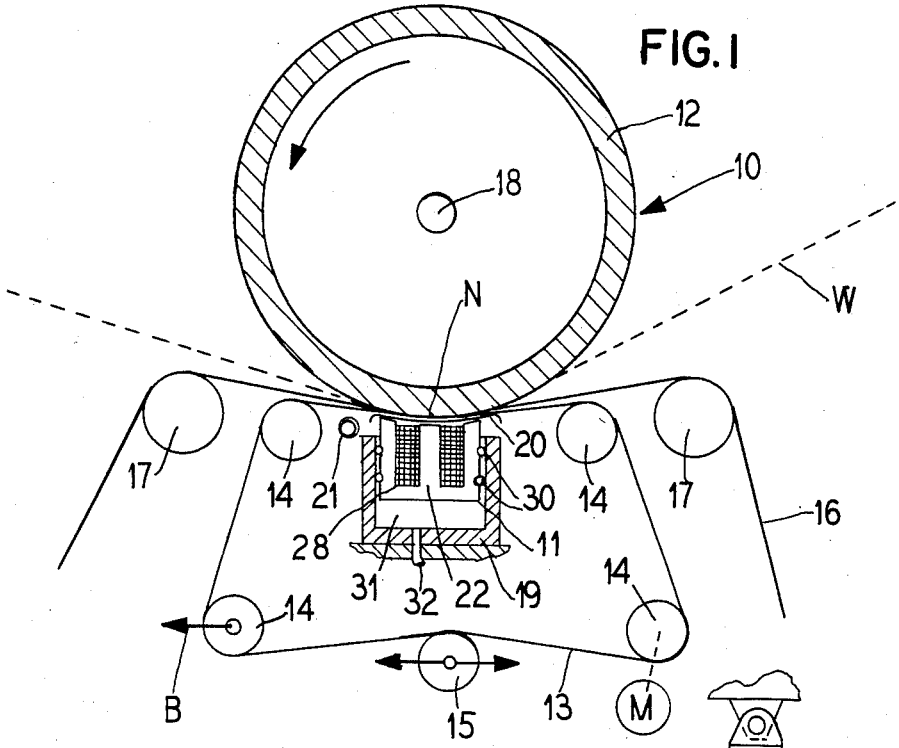
FIG. 1 is a schematic side view of an extended nip press of this invention having a shiftable electromagnet on one side of the nip and a fixed axis ferromagnetic roll on the opposite side of the nip.

The extended nip press assembly 10 of FIG. 1 has an electromagnet 11 on the bottom side of the wide or extended nip N, and a ferromagnetic top roll 12 on the opposite side of this nip. An impermeable belt 13 is trained in an open loop around rolls 14, one of which can be driven as shown at M and another can be biased as shown at B to tighten the belt. An external roll 15 guides the belt in its path having a top run through the nip. A porous felt 16 is trained around rolls 17 through the nip and receives the bottom face of a web W as it passes through the nip. The ferromagnetic roll 12 rotates about a fixed horizontal axis 18. The electromagnet 11 is slidably mounted in an open top fixed trough-like housing 19 and the top face of the electromagnet is covered with an arcuate non-magnetic thin sheet shoe 20, preferably formed from a sheet of stainless steel. This shoe 20 slidably supports the impermeable belt 13 and a shower pipe 21 ejects lubricating fluid between the shoe 20 and belt 13 at the entrance to the nip N.

As shown in FIG. 6, the electromagnet 11 is formed from a plurality of iron or magnetic steel core blocks 22 in side-by-side relation. The core blocks 22 are rectangular in shape with a flat bottom 23, flat parallel sides 24 and a transversely convex top 25. The blocks 25 have flat faces 26 adapted to slidably mate in side-by-side relation as illustrated.

Each block 22 also has a pair of spaced side-by-side open top slots 27 extended between the opposite faces 26 thereof. These slots terminate above the bottom 23 of each block. An electromagnetic coil 28 is wound through the slots 27 terminating below the top 25 of each block and extending beyond the end blocks as shown.

The slotted convex tops 25 of the blocks are covered with the thin non-magnetic shoe 20 which is curved to seat snugly on the tops of the blocks and which also has downturned lips 29 extending over and beyond the sides 24 of the blocks so that the impermeable belt 13 will be smoothly guided into and out of the nip N.

The open top trough-like housing 19 is fixedly anchored and extends across the full length of the press assembly 10 inside the loop of the belt 13. The electromagnet 11 slides vertically in this housing and the sidewalls 24 of the magnet blocks 22 are slidably guided by the sidewalls of the trough and sealed to the trough by seals or packings such as 30.

A sealed chamber 31 is provided between the bottoms 23 of the blocks 22 and the bottom of the trough and this chamber may receive hydraulic fluid under pressure from a pressure source 32 to force the electromagnet 11 and its cover 20 upwardly from the housing 19 to establish initial loading of the nip N. Other means for raising the electromagnet 11, such as screw rods, springs, or the like could be provided to hold the cover 20 against the impermeable belt 13 and to establish the initial loading of the nip.

The coil 28 is energized from a generator G or the like power source through a resistor R controlling the amplitude of the current to create inductor excitation of the electromagnet establishing a controlled flux, drawing the slidable electromagnet and its cover shoe 20 toward the magnetic roll 12, and establishing the desired nip loading. Since the cover 20 is supported on the core blocks 22 and since these blocks are relatively slidable, irregularities in the nip contour due to sagging, heat expansion and the like will be neutralized and the blocks will maintain a uniform loading along the full length of the nip.

Figure 2:
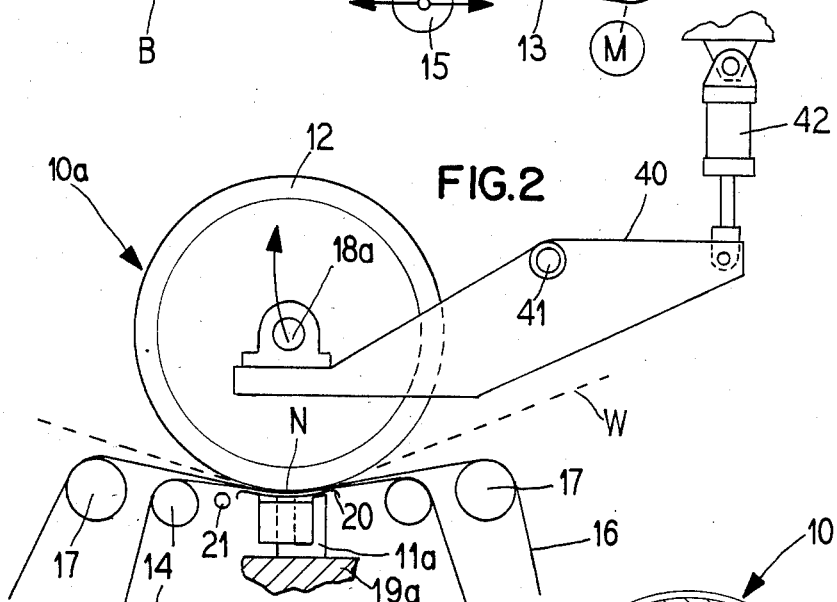
FIG. 2 is a schematic side view of an extended nip press of this invention having a fixed electromagnet on one side of the nip and a shiftable axis ferromagnetic roll on the opposite side of the nip.

In the extended nip press **10*a* of FIG. 2, parts corresponding with the parts described in the press 10 have been marked with the same reference numerals. In the press 10*a*, however, the ferromagnetic top roll 12, instead of being mounted on the fixed axis 18 of the FIG. 1 embodiment, is mounted on an axis 18*a* supported from a bearings carried by swing arms such as 40, pivoted about a center 41 and actuated by hydraulic or pneumatic cylinders such as 42. The roll 12** is thus raised and lowered relative to the nip N.

The electromagnet **11*a*, instead of being shiftable in a support such as 19, is fixedly mounted on a support 19*a***.

Figure 7:
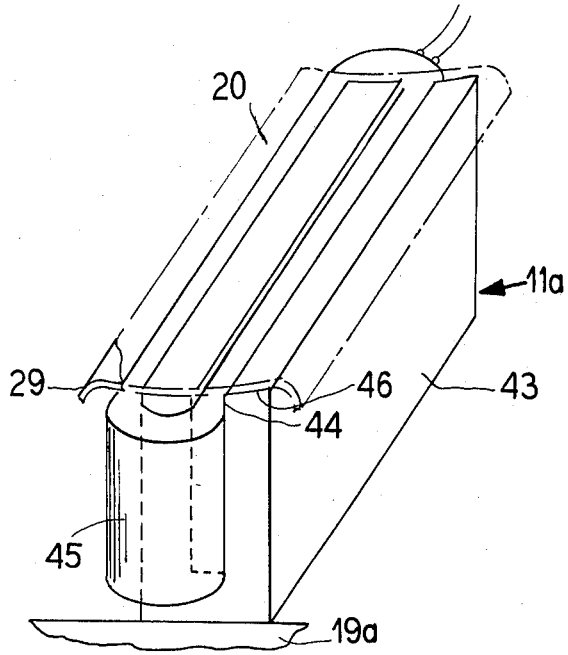
FIG. 7 is an isometric view of another form of electromagnet core for presses of this invention.

As shown in FIG. 7, the electromagnet **11*a* has a single core block 43 with a central open top slot 44 receiving one leg of an electromagnet coil 45. The coil 45 thus envelops only one side of the block 43 and has one leg lying in the slot 44 while the other leg is wrapped around an outer side face of the block. The top of the coil is below the slotted convex top 46 of the block and the cover 20 is supported on this slotted top 46**.

Initial loading of the nip N in the press **10*a* is accomplished by actuating the cylinder such as 42 to pull the ends of the arms 40 forcing the bearings for the axis 18*a* downward into pressure nip relation with the cover 20. The desired nip pressure is then established by energizing the coil 45 creating the magnetic flux which pulls the ferromagnetic roll 12 to the core 43 and establishes the nip loading. The web is conveyed through the pressure nip on the impermeable belt 13 which slides over the shoe 20 and the felt 16 covers the bottom face of the web in the same manner as in the press embodiment 10**.

From these descriptions of the press embodiments 10 and **10*a* it will be understood that the nip loading can initially be created by forcing the electromagnet core against the shoe 20 on one side of the nip or by forcing the roll 12** toward the shoe on the opposite side of the nip and then energizing the electromagnets to create a dense concentrated magnetic field through the entire nip area pulling the magnet and roll together to create the desired augmented nip load.

Figure 3:
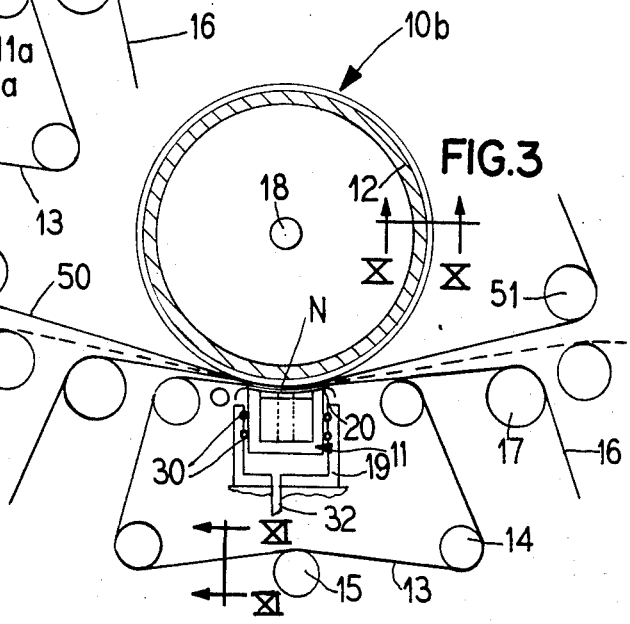
FIG. 3 is a schematic side view of an extended nip double felt press of this invention with a vented nip.

In the press **10*b* of FIG. 3 parts corresponding to parts illustrated and described in the embodiments 10** and 10*a* have been marked with the same reference numerals. In the embodiment 10*b*, however, a double-felted press is provided with the web passing through the nip N between the bottom felt 16 and a top felt 50 which is wrapped around the bottom of the roll 12 and directed by guide rolls 51 to meet the web W as it enters the nip N and to leave this web as it exits from the nip.

To facilitate drainage of water squeezed from the web W out of the extended nip N, the roll 12 is circumferentially grooved as illustrated at 52 forming channels for the flow of water out of the nip N as shown in FIG. 10.

The impermeable belt 13 may be longitudinally grooved as illustrated at 53 in FIG. 11 to form channels draining the water out of the nip.

It will be understood that either the roll 12 or the belt 13, or both, may be grooved.

It will also be understood that the press 10*b* may have the shiftable roll 12 and the fixed electromagnet 11*a* of the press 10*a* in place of the fixed roll 12 and the shiftable magnet 11 of the press 10.

The extended nip press 10*c* of FIG. 4 includes components the same as those illustrated and described hereinabove and the same reference numerals have been used to identify the components. In the press 10*c*, the roll 12 is replaced with the shiftable electromagnet 11 and the trough support housing 19. This magnet slides in the housing 19 and acts through the shoe 20 to form the top face of the extended nip N. A top impermeable belt 60 trained around guide rolls 61 and a drive roll 62 in an open loop surrounding the housing 19 has a bottom run extending through the nip under the top shoe 20.

A fixed lower electromagnet 11*a* is surrounded by the looped bottom impermeable belt 13 riding over the bottom shoe 20. The web W is conveyed through the nip between the belts 13 and 60. Lubricant can be fed between the belts and shoes 20 at the entrance to the nip.

The top electromagnet 11 can slide by gravity in the housing 19 to create an initial nip load. In addition, the initial load can be increased by hydraulic fluid, springs, or mechanical screws forcing the electromagnet 11 out of its housing 19 as described in the FIG. 1 embodiment.

The fixed bottom electromagnet 11*a* can be in the form of the single core end coil 45 with the external leg as shown in FIG. 7 or can be constructed as shown in FIG. 6.

The bottom belt 13 is conveniently driven by a driver roll 63 with a superimposed nip loading roll 64, the belt passing through the nip between the rolls 63 and 64.

A fibrous absorbent felt 65 is also provided between the top belt and the web W.

When the coils of the electromagnets 11 and 11*a* are energized the cores of these magnets are drawn or pulled together pushing the shoes 20 on opposite sides of the web toward each other and loading the nip to establish the desired pressure. Since both sides of the nip have electromagnets, the attraction force will be substantially greater, probably double, the force obtained in the embodiments 10, 10*a* and 10*b* where the electromagnet is provided only on one side of the nip.

The press 10*d* of FIG. 5 illustrates a calender roll embodiment for surface finishing a dry web D.W. threaded through the nip N between a calender roll 70 rotatable about a fixed axis 71 and a shiftable electromagnet 11 carried in a housing 19 is described hereinabove. The electromagnet 11 is covered by the non-magnetic shoe 20 described hereinabove which in turn receives the impermeable belt 13 conveying the web D.W. through the nip N. Controlled energization of the electromagnet 11 creates the desired calender nip loading for treating the dry web D.W.

Figure 8:
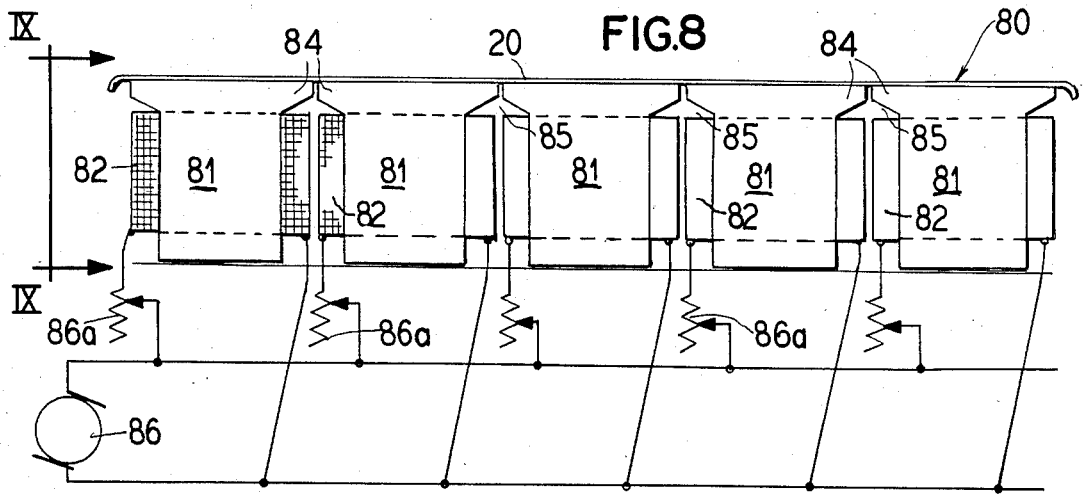
FIG. 8 is a schematic longitudinal view of an electromagnet shoe for the presses of this invention having a plurality of cores individually energized by coils and with expanded core heads to accommodate the individual coil wrappings.
Figure 9:
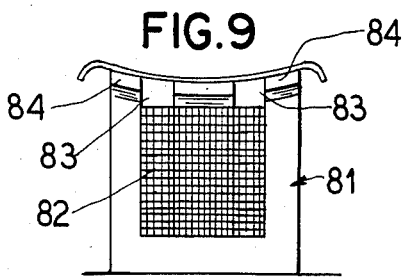
FIG. 9 is an end view along the line IX—IX of FIG. 8.

As shown in FIGS. 8 and 9 an electromagnetic loading of the shoe 20 for an extended nip press or a calender press as described hereinabove can be created by a modified electromagnet arrangement 80 composed of a plurality of electromagnet core blocks 81 each having its own individual exciting coil 82. As shown, the magnetic iron or steel core blocks have open top parallel slots 83 receiving the coil 82 with the ends of the coil projecting from the open ends of the slots. To provide for coil clearance between the adjacent core blocks 81, heads 83 are provided on the blocks extending beyond their front and back faces. This provides gaps or spaces 85 for the coils 82 without opening up wide gaps or spaces under the cover 20.

As diagrammatically illustrated in FIG. 8, the ends of each of the coils 82 can be individually energized from a power source 86 through controls 86*a* to vary the input to each coil as desired. In this manner, the cores 81 spaced along the length of the nip can exert selective loads on increments of the shoe 20 to compensate for variations in nip pressures caused by sagging rolls, non-uniform expansions, etc. along the length of the nip.

It will be noted any gaps between the nip and the magnetic cores are minimized since the cores only act through very thin non-magnetic shoes 20 to establish the flux lines creating the attraction with opposed ferromagnetic rolls or cores. Further these flux lines only have very short paths between opposite sides of the nip and are concentrated over the complete nip area without passing through air gaps which are formed in all line presses at the entrance and exit sides of the nip. In the extended nip presses of this invention the extended nip area has a width controlled by the width of the shoe and all of this area has a magnetic field passing directly therethrough without going through an air gap, although a very small gap will be formed by the non-magnetic material going through the nip.

The press 10*e* of FIG. 12 provides a series of nips N successively receiving the web. Components similar to those shown in the presses 10, 10*a*, 10*b* and 10*c* of FIGS. 1–4 have been marked with the same reference numerals. As shown, the press 10*e* has three nips N, each defined by a roll 12 and a shiftable electromagnet 11 in a trough housing 19 with a thin non-magnetic shoe 20 covering the core blocks 22 and a pressured chamber 31 urging the magnet and shoe toward the opposing roll to establish an initial nip load. Each roll 12 has a separate press felt 90 wrapped therearound through the nip N provided by the roll and opposed shoe 20. Each felt 90 as illustrated on the third roll 12 is looped around rolls 91, one of which can be driven as shown at M. An external stretcher roll 92 keeps the loop taut and an external guide roll 93 keeps the felt on path around the roll 12, through the nip N and around the rolls 91. A single impermeable looped belt 94 has a top run through all three nips N, around a drive roll 95 beyond the last nip N, around rolls 96 back to the front nip N and over a guide roll 97 along a bottom run thereof.

The magnets 11 can be energized to exert increasing nip loads in the successive nips N.

The rolls 12 of the press 10*e* can be replaced with electromagnets 11 as in the press 10*c* of FIG. 4.

A porous metal belt (not shown) can be used to replace the felts in the presses 10, 10*a*, 10*b*, 10*c* and 10*e* to thereby further reducing the non-magnetic gaps between the opposite rolls of the nips. Further the shoes 20 in the presses and calender stack arrangements can be eliminated to reduce the gaps, but because they are very thin, serve to keep the lubricating fluid away from the magnetic coils, and smooth out the nip surface, they are a desirable addition.

As shown in FIG. 13, a press roll 12*a* for the presses of this invention can be provided to minimize eddy current heating of the nip. The roll 12*a* has a cylindrical steel core 98 with end heads 99 carrying axles 99*a* to rotatably support the roll. The core receives a stack of thin laminates 100 therearound and squeezed together by the end heads 99. The stacked laminates 100 are washers about 0.004 to 0.020 inches thick and about 2 to 3 inches wide. They fit snugly on the core 98 and are composed of metal which does not develop eddy currents in the magnetic field generated by the electromagnets. Such eddy currents are created in conventional magnetic materials and heat the roll when it is driven through the magnetic field. When heat is not desired, laminated rolls such as 12*a* are used.

Useful materials for the laminates are oriented silicon iron forming an oxide coating on the surfaces of the thin washers 100, noncrystallines or amorphous ferrites and the like.

FIG. 14 illustrates the increases in attractive magnetic forces made possible by diminishing the gap through which the magnetic field must pass. Thus, as illustrated in the graph 101, plotting inductor excitation in terms of amperage turns from 0 to 14000 as abscissa 102 and static attractive forces in terms of pounds per linear inch as ordinates 103, the attractive force greatly increases as the gaps decrease from $\frac{3}{4}''$ down to $\frac{1}{8}''$. Extrapolating the 0.125" curve to 14000 amp. turns shows that the electromagnets used in the extended press nip assemblies of this invention are capable of producing a force of 500 pounds per linear inch and that about twice this value can be achieved with two mutually attractive magnets as in the press assembly 10*c* of FIG. 4.

The stacked heights of the non-magnetic shoes, belts, felts, and webs in the nips N of the presses of this invention, only result in gaps of 0.05" to 0.36" between the magnetic cores and the ferromagnetic rolls or the opposed magnet core. As explained above, the impermeable belt can ride on the lubricated core legs of the electromagnet eliminating the shoe 20. The shoe, however, helps to keep the lubricant fluid from the coils. In such assemblies the shoe would only have a thickness of not more than about 0.125 inches, each belt would have a thickness of 0.020 to 0.10 inches and, of course, the thickness of the webs would be negligible in the order of 0.002 to 0.010 inches. The impermeable belts are preferably composed of rubber or a plastic material such as polyurethane, but could be thin impermeable metal belts further reducing the non-magnetic gaps. The felts, as explained above, can be replaced by thin porous flexible metal belts into and through which the expelled water can flow and still further reduce the gaps. The shoes 20 can be any non-magnetic material such as hard rubber, plastics material, stainless steel or the like. The machine direction width of the shoe can vary to suit conditions, but is wide enough to develop a large area magnetic field. A reasonable minimum width is about 4" with a maximum of about 18". The cross machine direction width of the shoes can vary from narrow up to the full width of the machine. The full width shoe should be flexible with cross machine direction to conform to irregularities in the belts, felts, web and mating faces of the roll and magnet core. If desired the shoes can be spaced up to 6" apart.

As explained above, as the metal rolls rotate through the magnetic field, heat is generated which can be helpful in wet presses. If heat is not wanted the rolls can be laminated as shown in FIG. 13 and as described above.

From the above description it should be understood that this invention provides extended nip presses for treating wet or dry fibrous webs wherein nip loading is created or augmented by electromagnets having cores acting only through minimum gaps creating the flux lines across the entire wide nip area which pull opposite sides of the nips toward each other to establish the desired nip loading throughout the entire width and length of the extended nip.

I claim as my invention:

1. An extending nip press for a papermaking machine through which a formed web passes comprising a non-magnetic impermeable belt, a felt, and an extended nip defined by a first nip member and a second nip member which conforms to the first nip member, mounting means for one of said nip members permitting movement toward and away from the other nip member, said press further comprising in combination electromagnetic means disposed within the first nip member for generating flux for electromagnetically cooperating with the second nip member, said electromagnetic means being coextensive with the extended nip in a direction transverse to the direction of movement of the web through the nip, a non-magnetic shoe supported by and covering said electromagnetic means disposed between said electromagnetic means and the belt to be urged against the belt upon excitation of said electromagnetic means for generating sufficient force between the second nip member and the felt to remove water from the web by pressure, and said shoe having a thickness selected for minimizing the distance between the electromagnetic means and the second nip member such that substantially all of said flux passes through said shoe to said second nip member with substantially no air gap therebetween for increasing the pressure exerted on the web during excitation of said electromagnetic means.

2. The press of claim 1 wherein the second nip member is a ferromagnetic roll and the shoe has an arcuate configuration conforming with the roll periphery.

3. The press of claim 1 wherein the first and second nip members each have electromagnetic means disposed therein and a non-magnetic shoe is supported by each electromagnetic means.

4. The press of claim 1 wherein the electromagnetic means has a ferromagnetic core block traversing the full width of the formed web with an open top slot along the length thereof covered by the shoe, and an exciting coil of the electromagnetic means has a leg filling said slot.

5. The press of claim 4 wherein the core block has a pair of parallel open top slots along the length thereof covered by the shoe and the exciting coil has legs filling both slots.

6. The press of claim 1 wherein the electromagnetic means has a core composed of a row of side-by-side slidable blocks covered by the shoe and an exciting coil is wrapped around each block.

7. The press of claim 1 wherein the felt is interposed between the belt and web.

8. The press of claim 1 wherein the second nip member is a ferromagnetic roll and the electromagnetic means heats the roll.

9. The press of claim 8 wherein the ferromagnetic roll has circumferential grooves forming channels for flow of water out of the nip.

10. The press of claim 1 wherein the belt is longitudinally grooved to form channels draining water out of the nip.

11. The press of claim 1 wherein the electromagnetic means includes a housing, a core shiftable in the housing toward the second nip and means in the housing urge the core toward the second nip to create an initial nip load.

12. The press of claim 1 including a plurality of pairs of first and second nip members defining a plurality of successive extended nips and wherein the belt is trained through all of the nips to convey the web successively through the nips.

13. The press of claim 12 wherein the second nip member of each press has a separate felt trained therethrough to cover the web on the belt.

14. The press of claim 13 wherein the second nip member of each press is a ferromagnetic roll and a separate felt is trained around each roll to cover the web as the belt conveys the web through the nips.

15. The press of claim 1 wherein the second nip member is a roll having a ferromagnetic cylindrical core, a stack of thin washer laminates surround the core radiating therefrom and composed of a metal which does not develop eddy currents in the magnetic field generated by the electromagnetic means, and means on the core squeeze the laminates together.

16. The press of claim 1 wherein the shoe has a lip diverging from the belt entering the nip and means adjacent the lip to introduce lubricant between the shoe and belt.

17. The press of claim 1 wherein the electromagnet has a row of separate core blocks extending across the width of the papermaking machinery, a separate exciting coil wound around each block, and means for variably energizing each exciting coil to control the strength of the magnetic field across the papermaking machinery.

* * * * *